United States Patent [19]

Hamilton

[11] Patent Number: 4,597,812

[45] Date of Patent: Jul. 1, 1986

[54] HANDICRAFT BONDING

[75] Inventor: Bonnie Hamilton, Eugene, Oreg.

[73] Assignee: Solar-Kist Corporation, LaGrange, Ill.

[21] Appl. No.: 581,811

[22] Filed: Feb. 21, 1984

[51] Int. Cl.[4] ..... B44C 1/10

[52] U.S. Cl. ..... 156/63; 156/289; 156/299; 156/323; 428/79; 428/247; 428/542.2

[58] Field of Search ..... 156/63, 323, 240, 289, 156/299; 428/79, 906.6, 914, 247, 542.2; 112/403, 439

[56] References Cited

U.S. PATENT DOCUMENTS

| | | | |
|---|---|---|---|
| 2,096,750 | 10/1937 | Lawrence | 156/277 X |
| 3,783,073 | 1/1974 | Warnberg | 156/323 X |
| 3,816,211 | 6/1974 | Haigh | 428/906.6 X |
| 3,932,250 | 1/1976 | Sato et al. | 156/323 X |
| 3,974,010 | 8/1976 | Cox | 156/93 |
| 3,993,527 | 11/1976 | Ohta | 156/323 X |

*Primary Examiner*—Robert A. Dawson

*Attorney, Agent, or Firm*—Hill, Van Santen, Steadman & Simpson

[57] ABSTRACT

A new and improved method of joining articles, especially fabrics and their equivalents adhesively by applying heat and/or pressure through a reusable polytetrafluoroethylene pressing sheet, thereby avoiding adhesive contamination of the heat and/or pressure applying device as well as other environmentally contacting surfaces.

19 Claims, 14 Drawing Figures

HANDICRAFT BONDING

This invention relates to the handicraft arts, and is more particularly concerned with avoiding contamination of the means for applying heat and/or pressure when adhesively joining handicrafts.

Craft objects such as quilts, pillows, hoop wall hangings, and the like, may require that pieces of various types and colors of fabric be cut to preferred shapes, applied and grouped and attached by sewing or other fastening means to a base fabric substrate to form artistic designs, pictorial representations, decorative trim, and the like. The completed handiwork may be referred to as appliqué. The smaller pieces of material to be applied to the usually larger base fabric may be referred to as appliqué pieces.

Fastening of the appliqué pieces to the base fabric may be effected by hand sewing or machine sewing. Craft fabricators, appliqué collectors, and other experts in this field consider that the highest quality of appliqués are achieved when the sewing is done by hand, demonstrating personal sewing skills, and, in effect, continuance of old world and pioneer craftsmenship. However, hand sewing is generally tedious, time consuming and requires long practice to attain quality results. Understandably hand sewn handicrafts are generally fairly expensive.

Machine sewing of handicrafts, such as in appliqué ing, is very widely practiced and accepted since that technique enables more product to be made in any given time, and quality production by this technique can be learned in a much shorter time, and thus attaining lower costs then the hand sewn articles. However, purists consider machine sewn appliqués inferior to quality hand sewn appliqués. Machine sewing does present some problems in that poorly pinned or basted appliqué pieces are difficult to stabilize under machine sewing conditions and sometimes produce inaccurate appliqué piece positioning, wrinkles and puckering.

In more recent times improvements in appliquéing and other fabric manipulating operations such as making cuffs, turned over hems, drapery or curtain or shade headers, etc., have been attained by the provision of special bonding adhesives (for use alone or in addition to pins or basting) to help stabilize appliqué piece positioning and smoothness. In a popular form, adhesives for this purpose are supplied as dry, heat reactivatable, fusible webbing in sheet or strip form and having a thin net or mesh appearance. This type of fusible webbing is dry and nontacky at even the highest weather generated temperature conditions, and in a popular form is made from polyamide plastic having a melting point or fusing temperature of 210° F. to 235° F.

In machine appliqué, or other work, the fusible webbing is sandwiched between the pieces to be bonded and the assembly then subjected to heat and pressure of a pressing iron to fuse the adhesive material and bond the assembly prior to machine sewing.

There are, nevertheless, still serious problems. Generally the fusible webbing manufacturers require that the user cut the fusible webbing ¼ inch smaller all around than the appliqué piece, and generally warn that the fusible webbing should not extend onto the pressing surface, in order to avoid the fused adhesive contacting and contaminating the soleplate of the pressing iron. This may result in some or all of the margins of the bonded piece remaining unbonded, so that the edges may fray or ravel. Most fusible webbing manufacturers also warn against ironing, that is moving the iron back and forth, while effecting the bonding maneuver on the pieces, and will instruct that only pressing, that is moving the iron up and down, should be practiced to avoid displacement of the pieces.

To protect against contaminating the iron, the manufacturers' instructions may suggest using a pressing cloth between the iron and the materials to be bonded. Sometimes wet or damp cloths are suggested to reduce the fusible webbing melting point, and to protect the fabrics from excessive iron temperature. Moist pressing cloths will produce steam during the pressing and although this may help to eliminate wrinkles in the pressed fabrics, there is a degree of messiness in the use of wet or damp pressing cloths, and the moisture may damage the materials being bonded. Many users are critical of damp or wet pressing cloths. In addition, there is no assurance that the pressing cloths may not become contaminated by the fused adhesive, and become stuck, or at least transfer the contamination to other work when the cloths are reused.

An important object of the present invention is to overcome the disadvantages, drawbacks, inefficiencies, shortcomings, and problems inherent in prior handicraft bonding techniques by the provision of a new and improved method of adhesive bonding.

Another object of the invention is to provide a new and improved method of handicraft bonding employing adhesive, and which can be effected dry and free from adhesive contamination.

Still another object of the invention is to provide a new and improved method of handicraft bonding employing an overlay sheet to which adhesive is nonadherent.

A further object of the invention is to provide a new and improved method of laminating fusible adhesive to a surface by heat and pressure applied through an overlay to which the adhesive will not adhere.

To this end, the present invention provides handicraft bonding by use of adhesive which at least in one phase is in a fluent state for adherence to a compatible surface, comprising assembling in face-to-face relation members to be bonded to one another by a layer of said adhesive interposed between said members; applying to the assembled members having the layer of adhesive therebetween an essentially nonporous overlay sheet characterized by having all of the attributes of being thin, reusable, substantially frictionless, translucent and nonadherent with respect to the adhesive; exerting bonding pressure through the overlay sheet toward said members and thereby squeezing the adhesive between said members, effecting bonding of the pressurized assembled members by means of the adhesive, and finally removing the overlay sheet.

The present invention also provides for handicraft bonding by use of adhesive which at least in one phase is in a fluent state for adherence to a compatible surface, comprising assembling a sheet-form dry heat reactivatable adhesive layer onto a compatible surface of a member, superimposing onto the adhesive layer on said compatible surface an essentially nonporous overlay sheet characterized by having all of the attributes of being thin, reusable, heat conductive, substantially frictionless, nonadherent with respect to the adhesive and temperature resistant without deterioration at the fusion temperature of the adhesive, transfering through the overlay sheet toward the assembly heat sufficient to fuse said adhesive, exerting pressure through said overlay sheet toward said assembly and thereby to said adhesive, laminating the fused adhesive to said surface of the member, and finally removing said overlay sheet.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure, and in which:

FIG. 1 is a perspective view showing a representative appliquéd article;

FIGS. 2 to 6 demonstrate successive steps in the method of making the article of FIG. 1, FIG. 6 being a sectional detail view taken substantially along the lines VI—VI of FIG. 5;

Figure 1:
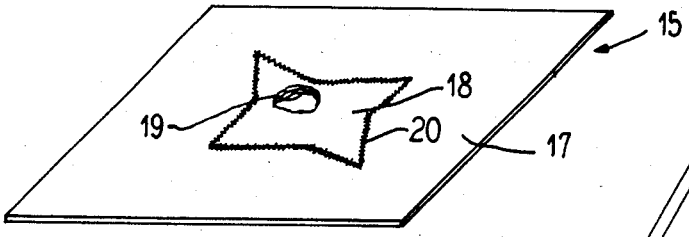

In FIG. 1 is depicted a representative assembly 15 which is adapted to be made employing the method of the present invention. This assembly comprises a base member 17 to which is applied in face-to-face relation a superposed member 18, in this instance an appliqué secured to the base member 17 by means of adhesive 19. If desired, the edge of the appliqué 18 may be hemstitched as shown at 20 to avoid raggedness, raveling or the like, where the material of the appliqué may desirably invite or require such treatment. Some materials may not require such treatment where the adhesive 19 extends entirely to the edge or edges of the member 18 and the structure of the material of the piece 18 is such as to present a clean crisp edge. Either or both of the pieces 17 and 18 may be a suitable fabric, either woven or nonwoven, or they may comprise other materials which are ornamentally or otherwise compatible for whatever ornamental or utilitarian purposes desire.

Figure 5:
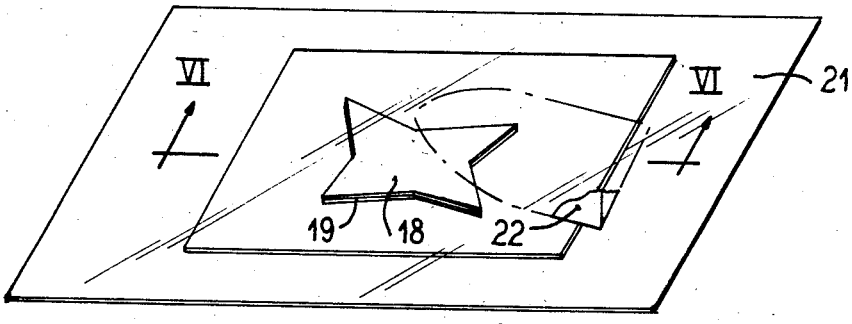
Figure 6:
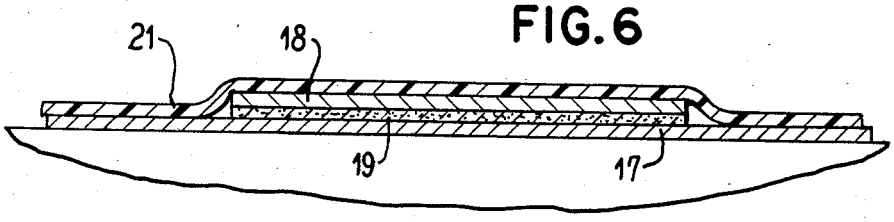

According to the present invention, the members or pieces 17 and 18 are assembled in face-to-face relation as shown in FIGS. 5 and 6 with the adhesive 19 between the assembly. Then there is applied to the assembly an essentially nonporous overlay sheet 21 characterized by being nonadherent with respect to the adhesive 19 so that if any of the adhesive escapes beyond the edges defining the piece 18, the adhesive will not contaminate the overlay sheet 21. The purpose of the overlay sheet 21 is to serve as a separable holddown and protective layer between the appliqué piece 18 and any preferred means having a pressing surface such as a conventional hand operated flatiron 22 for applying heat and/or pressure by means of its soleplate to and through the sheet 21 to assure firm bonding of the pieces 17 and 18 by the interposed adhesive 19.

To meet all of the desirable operating criteria, the overlay sheet 21, which may also be referred to as a pressing sheet, has in addition to the essential characteristic of nonadherence with respect to the adhesive 19, a number of other attributes. It should be as thin as practicable and pliable so that it can be readily manipulated and can be supplied at low cost. The sheet should be repeatedly reusable for not only convenience in use, but also for the sake of economy. Further, the sheet should be quite durable to resist damage in use, for example, against scuffing or other manipulative stress applied as by means of the pressing iron 22.

Where the adhesive 19 is of the highly desirable kind that is heat liquified or fused to effect bonding, the overlay sheet 21 must be adequately heat conductive so that heat from the iron 22 will quickly penetrate therethrough to the piece 18 and the adhesive 19 interposed between it and the piece 17 for fusing the adhesive and effecting the bond.

Another highly desirable attribute of the overlay sheet 21 should be that it presents a substantially frictionless surface at least on its outer face so that not only may the iron 22 be applied for pressing the pieces together through the overlay sheet 21, but the iron may be slidably moved on the overlay sheet while ironing or pressing pressure is applied.

A further very desirable attribute of the overlay sheet 21 should be translucence. This is important to permit ready visualization through the overlay sheet of the appliqué piece 18 so as to at all times have control over its position, which in some instances may be fairly critical for either ornamental or utilitarian purposes.

Of course, another quite important attribute of the overlay sheet 21 must be that it be temperature resistant and stable without deterioration at the fusion temperature of the adhesive 19, and with a comfortable heat-stable and safety range beyond the fusing range of the adhesive.

An excellent material for the pressing overlay sheet 21 comprises a fluoropolymer, and more particularly polytetrafluoroethylene film of about 1 to 5 mils thickness, 2 mils thickness being preferred because it provides a substantial safety factor against damage from normal mechanical hazards in use; it is cost effective and adequately translucent for visualizing the subjacent surfaces. Norton Company's Norlon in a skived virgin polytetrafluoroethylene film has been found to be especially satisfactory for the present purpose. These materials are amply tolerant of pressing iron temperatures up to at least 500° F. On direct heat source contact, the polytetrafluoroethylene film has excellent heat transfer capability, and all of the other desirable attributes described above, not the least of which is the nonadherence of the adhesive 19 thereto.

Film or sheet material having attributes comparable to the polytetrafluoroethylene film may be used, such as parchment-like silicone impregnated paper, although this material is not as pliable nor as translucent, especially under heat, as the polytetrafluoroethylene. Therefore the polytetrafluoroethylene is preferred, although if that product is not readily available, the silicone treated paper may be substituted.

While the adhesive 19 may be applied as a liquid, such as a hot melt adhesive, or even a cold liquid adhesive which will set at atmospheric temperature or under heat, a preferred form of the adhesive is the convenient and readily available fusible netting or mesh form webbing of 100% polyamide plastic readily obtainable on the market in sheet form, and which has heretofore been widely used in appliqué work by interposing the same between the appliqué and the base cloth and applying heat and pressure to the assembly. Where a pressing iron is applied directly to the assembly, the soleplate of the iron may become contaminated with the adhesive and then it requires a considerable effort to remove the contaminating adhesive from the sole plate. Where a pressing cloth has been used adhesive migration has with some frequency contaminated the pressing cloth. Pressing cloths have a tendency to move when an iron is rubbed thereon in an ironing stroke, because of the relatively high coefficient of friction of the cloth. Therefore, instructions for applying heat and pressure in appliquéing generally caution that only direct pressing and not ironing be effected. Further, pressing cloths are opaque and therefore do not permit visualizing the subjacent surfaces of the appliqué and base cloth.

Figure 2:
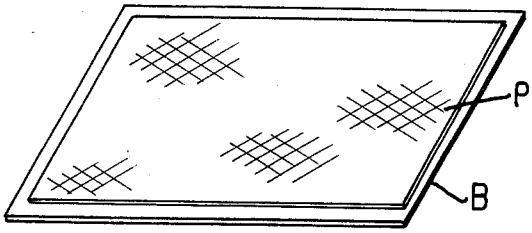
Figure 3:
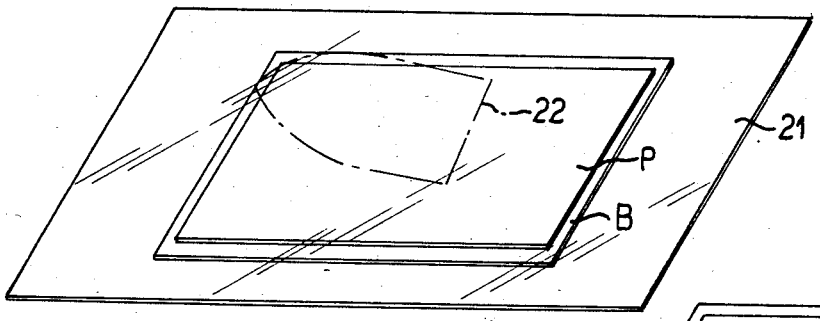
Figure 4:
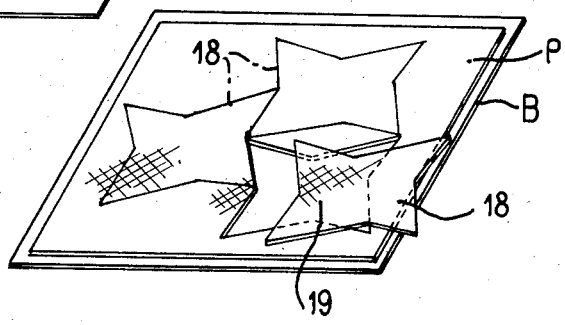

Not only are the problems inherent in the use of pressing cloths overcome by the method of the present invention, but it is also quite practical to apply and laminate the heat reactivatable adhesive directly to the back or bonding surface of a piece of material from which appliqué or other pieces are to be cut or otherwise manipulated, whereafter the appliqué or other pieces carrying the adhesive lamina are adapted to be bonded to a base by applying heat to the assembly to fuse the adhesive lamina as the bonding agent. By way of example, FIGS. 2–4 are referred to as representing this technique. A blank sheet B of any preferred material and large enough to derive therefrom a number of cutout appliqué pieces has applied thereto a sheet P of the fusible mesh bonding adhesive, desirably trimmed to a size slightly less than the size of the blank B. Then the overlay sheet 21 is applied over the assembly of adhesive layer P on the blank B. Depending upon the materials to be bonded together, the heated iron 22 is set to attain a heat greater than 210° F. to 250° F., which will penetrate through to the adhesive without damage to the materials being bonded together. The heated iron is then applied with a pressing or combination of pressing and ironing action onto the assembly. By reason of the translucence of the overlay sheet 21, it can be observed when the fusible webbing P is completely melted. By having the fusible webbing P cut smaller then the sheet of material B, running over of the fused adhesive is generally avoided. If greater precaution is desired against possible run-over onto the ironing base such as an ironing board or the like, a second pressing sheet 21 may be used as an underlay because any fusible adhesive that may run onto the underlay will readily peel off of the underlay as well as the overlay sheet 21 after the adhesive cools and solidifies.

After the fusible adhesive layer P has been fused and laminated to the blank B, the blank carrying the fused adhesive layer may be cut up into appliqué pieces 18 as best visualized in FIG. 4. Thereafter, the appliqué pieces 18 carrying on their backside the corresponding portions of the adhesive layer P, now identified as 19, are adapted to be adhesively bonded to the base member 17 or its equivalent, as desired, in the manner described in respect to FIGS. 5 and 6, by application of the overlay sheet 21 over the assembly and then subjecting the assembly through the sheet 21 to adhesive fusing temperature and bonding pressure. A great advantage of this mode of preapplying the fusible adhesive to the back of the material from which the appliqué pieces are to be cut resides in that the adhesive is continuous over the entire back of the appliqué piece and coincident with the edges of the piece. Therefore when the appliqué piece 18 is bonded to its base member 17, the appliqué piece is adapted to be thoroughly bonded clear to its edges.

Figure 7:
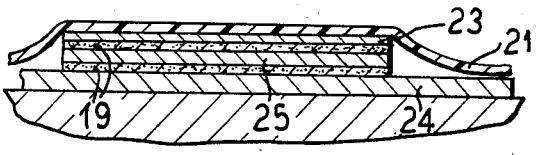
FIG. 7 is a view similar to FIG. 6 but showing a modification.

At times it may be desirable to apply appliqué pieces to strongly contrasting carrying sheets. For example where a light colored thin fabric appliqué 23 (FIG. 7) is to be bonded to a carrying member sheet 24 of a strong color, such as where the appliqué piece 23 is of a light pastel shade and the base fabric 24 is of a strong contrasting or dark color, a relatively opaque intermediate neutral or appliqué color-compatible interface undercover or opacity piece 25 of the same shape as the appliqué 23 may be bonded to and between the members 23 and 24 by means of the adhesive 19 which is adapted to be of the heat fusible type, fusing heat and bonding pressure being applied through the overlay pressing sheet 21.

Figure 8:
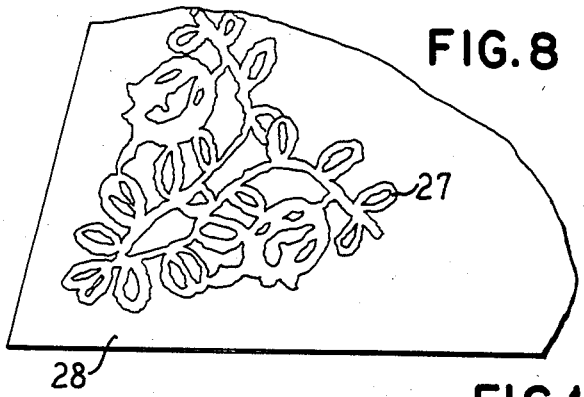
FIG. 8 is a fragmentary perspective view showing a decorative, lace appliqué article.
Figure 9:
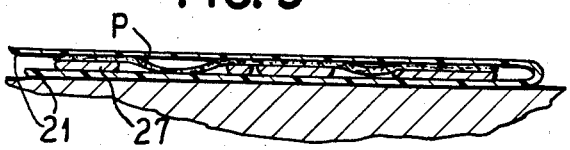
FIG. 9 is a fragmentary sectional detail view depicting a step in producing the article of FIG. 8.

Adhesive bonded appliquéing of lace such as the lace piece 27 (FIG. 8) has heretofore presented a considerable problem because of the fused heat reactivatable adhesive showing through the openings in the lace after it has been bonded to a carrying sheet 28. By utilizing the method of the present invention, it is entirely practical to, in effect, precoat the back face of the lace with the fusible, that is heat reactivatable adhesive, and after picking out the solidified adhesive at the openings through the lace, fusion bonding the lace to the carrier sheet or similar member. For example, as shown in FIG. 9, the lace piece 27 is adapted to be enveloped in the pressing sheet 21 folded upon itself and with a piece of the fusible adhesive webbing P laid over the back face of the lace piece and the pressing sheet folded over onto the netting. The thus pressing-sheet-encased assembly is subjected to heat and pressure to fuse the adhesive onto the back of the lace piece. After cooling, the lace piece is removed from the press sheet and the fused adhesive showing at the openings through the lace picked out. Then the lace piece 27 with the fusible adhesive 19 laminated to its back is placed on the base sheet 28, the pressing sheet 21 applied to the assembly and heat and pressure applied to re-fuse the adhesive 19 and effect bonding of the lace piece 27 to the base 28.

Figure 11:
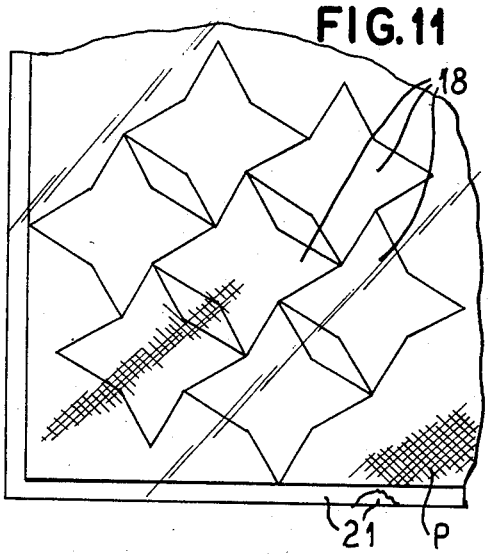
FIG. 11 depicts a step in method of producing multiple applique pieces from one piece of fabric.
Figure 10:
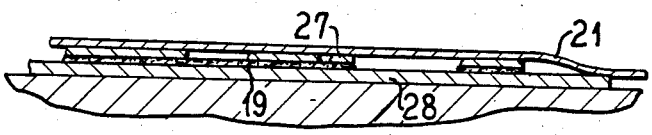
FIG. 10 is a fragmentary sectional detail view showing the execution of another step in making the article of FIG. 8.
Figure 12:
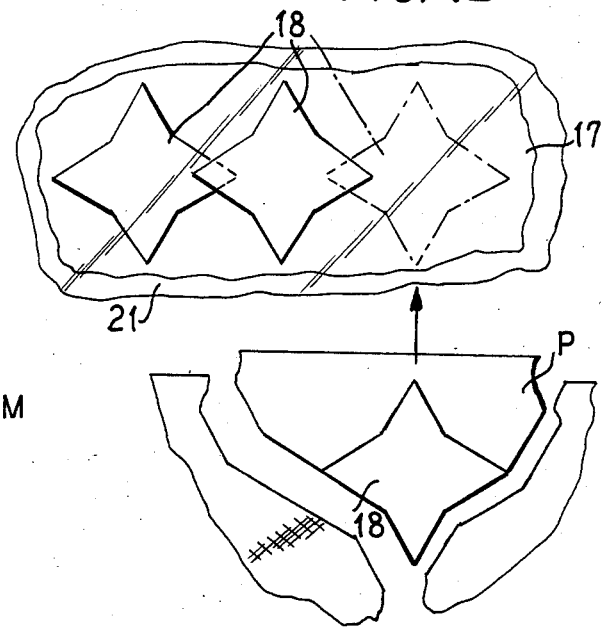
FIG. 12 depicts successive steps in utilization of the appliqué pieces of FIG. 11.

If desired, a plurality of precut appliqué pieces 18 of whatever desired shape may be equipped with the fusible adhesive by assembling them substantially as shown in FIG. 11 in sandwiched relation between a pair of the pressing sheets 21 or a folded over pressing sheet and with a sheet P of the fusible adhesive webbing superimposed on the back surfaces of the pieces. Then by applying heat and pressure to the assembly, the fusible adhesive is fused onto the backs of the pieces 18. Thereafter, the pieces can be readily separated from one another be breaking the intervening web of fused adhesive or trimming them from the web of the adhesive. Then the pieces are adapted to be applied in any desired arrangement, such as shown in FIG. 12, wherein the pieces 18 stripped from the fused adhesive web P are arranged as desired on the base sheet 17 with the adhesive-carrying backs facing the base sheet or disposed in more or less overlapping relation to one another. By application of heat and pressure through the pressing sheet 21 the pieces 18 are adhesively bonded to the base sheet 17 and to one another in the particular orientation selected. It will be understood, of course, that the appliqué pieces 18 may take any preferred shape and may be arranged in any preferred relationship to one another on the base sheet 17 and which base sheet may be of any size and geometric shape preferred.

Figure 13:
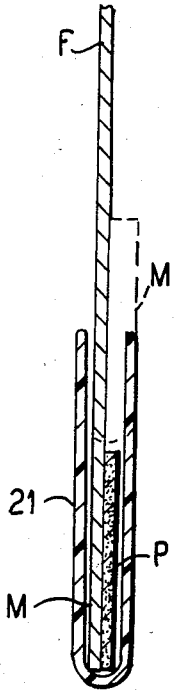
FIGS. 13 and 14 depict successive steps in producing a hem or cuff within the principles of the present invention.
Figure 14:
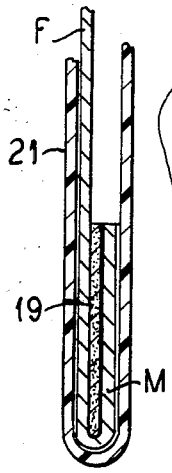

Not only is the method of the present invention advantageous for appliquéing, but the method may be used to fix hems, cuffs, headings, and other configurations without stitching. For example, a fabric piece F which is to have its margin M turned over or hemmed has applied thereto a strip of the heat reactivatable fusible adhesive mesh P. The adhesive P is fused onto the margin M by heat and pressure applied through the pressing sheet 21 folded over about the margin M and the assembled adhesive layer P. Thereafter the fabric F can be handled, trimmed, cut, sewn and the like until ready to finish the hem or cuff. Then, the adhesive coated margin M may be folded onto itself as indicated in dash outline in FIG. 13 and as shown in full outline in FIG. 14, and the layer of adhesive 19 which has been fusibly attached to the margin M and now folded over onto the fabric F is adhesively secured to the back of the fabric F by applying heat and pressure through the pressing sheet 21 folded thereabout as shown. Of course, if preferred, the hem or cuff may be completed in one pass by sandwiching the adhesive in the form of a strip of the reactivatable webbing, between the back face of the fabric and the folded over margin M and then at one time effecting fusion bonding of the margin M to the fabric by means of the fusible adhesive.

Although appliqués and hems or cuffs have been particularly described by way of example, it will be readily apparent that there are many ways in which the method can be utilized to advantage in adhesively securing members together, such as attaching clothing patches and reinforcements, attaching pockets to aprons and other articles of clothing, attaching trimming to various fabric articles, and the like. Numerous and varied fabrics can be safely and efficiently secured together or to other fabrics and nonfabrics which can safely assume the heating involved in fusing the heat reactivatable adhesive.

It will be understood that variations and modifications may be effected without departing from the spirit and scope of the novel concepts of this invention.

I claim as my invention:

1. A method of handicraft bonding by use of adhesive which can be fused for adherence to a compatible surface, comprising:

supplying said adhesive in the form of a polyamide mesh web;

assembling in face-to-face relation members to be bonded to one another by a layer of said adhesive interposed between said members;

applying to the assembled members having said layer of adhesive therebetween an essentially nonporous self-supporting overlay sheet characterized by having all of the attributes of being thin, reusable, substantially frictionless, translucent and nonadherent with respect to said adhesive;

placing a pressing surface of a pressure applying means onto said applied overlay sheet;

fusing said layer of adhesive;

exerting bonding pressure by means of said pressure applying means through said overlay sheet toward said members and thereby squeezing the adhesive between said members;

effecting bonding of the pressurized assembled members by means of said adhesive;

preventing by means of the protective layer provided by the overlay sheet any contamination of said pressing surface by adhesive that may migrate beyond the member which is contiguous to said pressing surface during said squeezing;

and finally removing said pressure applying means and said overlay sheet from said bonded members.

2. A method according to claim 1, which comprises applying an underlay sheet having all of the enumerated characteristics of said overlay sheet under the assembly before exerting said bonding pressure and effecting said bonding of the pressurized assembled members and adhesive.

3. A method according to claim 1, which comprises selecting said overlay sheet from polytetrafluoroethylene and silicone treated paper.

4. A method according to claim 1, which comprises folding said overlay sheet about said assembled members and then effecting said bonding pressure and said bonding.

5. A method of handicraft bonding, comprising:

assembling a sheet-form dry heat reactivatable adhesive layer onto a compatible surface of a member;

superimposing onto the adhesive layer on said compatible surface an essentially nonporous self-supporting overlay sheet characterized by having all of the attributes of being thin, reusable, heat conductive, substantially frictionless, nonadherent with respect to the adhesive and temperature resistant without deterioration at the fusion temperature of the adhesive;

placing the soleplate of a heated flatiron onto said applied overlay sheet;

transfering from said soleplate through said overlay sheet toward the assembly of said member and said adhesive layer heat sufficient to fuse said adhesive;

exerting pressure by said flatiron soleplate through said overlay sheet toward said assembly and thereby to said adhesive;

laminating the fused adhesive to said surface of the member;

preventing by means of the protective layer provided by the applied overlay sheet any contamination of said soleplate by said fused adhesive;

and finally removing said flatiron and said overlay sheet.

6. A method according to claim 5, which comprises applying an underlay sheet having all of the enumerated characteristics of said overlay sheet under the assembly before exerting said bonding pressure and effecting said bonding of the pressurized assembled members and adhesive.

7. A method according to claim 5, which comprises selecting said overlay sheet from polytetrafluoroethylene and silicone treated paper.

8. A method according to claim 5, which comprises supplying said adhesive in the form of a polyamide mesh web.

9. A method according to claim 5, which comprises after said laminating of the heat reactivatable adhesive to said member assembling to member with another member and with the heat reactivatable adhesive lamina therebetween, and heat reactivating the adhesive lamina and thereby bonding the members together.

10. A method according to claim 5, which comprises laminating said adhesive by fusion onto the back surfaces of a plurality of appliqué pieces, separating one of said pieces and the adhesive lamina thereon from the other pieces, and providing the separated piece as one of a plurality of members to be bonded to one another.

11. A method according to claim 5, which comprises folding said overlay sheet about said assembled member and adhesive layer and then effecting said fusing laminating.

12. A method of handicraft bonding, comprising:

assembling a sheet-form dry heat reactivatable adhesive layer onto a compatible surface of a member;

superimposing onto the adhesive layer on said compatible surface an essentially nonporous self-supporting overlay sheet characterized by having all of the attributes of being thin, reusable, heat conductive, substantially frictionless, nonadherent with respect to the adhesive and temperature resistant without deterioration at the fusion temperature of the adhesive;

placing the soleplate of a heated flatiron onto said applied overlay sheet;

transfering from said soleplate through said overlay sheet toward the assembly of said member and said adhesive layer heat sufficient to fuse said adhesive;

exerting pressure by said flatiron soleplate through said overlay sheet toward said assembly and thereby to said adhesive;

laminating the fused adhesive to said surface of the member;

preventing by means of the protective layer provided by the applied overlay sheet any contamination of said soleplate by said fused adhesive;

finally removing said flatiron and said overlay sheet;

placing said member with the adhesive on its surface in face-to-face relation onto a second member;

applying to the assembled members an essentially nonporous self-supporting overlay sheet characterized by having all of the attributes of being thin, reusable, substantially frictionless, translucent and nonadherent with respect to the adhesive and selected from polytetrafluoroethylene and silicon treated paper;

applying said soleplate of said flatiron onto said overlay sheet and while exerting bonding pressure by means of the flatiron applying heat from the flatiron through said overlay sheet and fusing and squeezing the adhesive between said members for thereby effecting bonding of the pressurized assembled members by means of the adhesive;

preventing by means of said overlay sheet contamination of said soleplate by fused adhesive that may migrate past said members during said squeezing;

and finally removing said flatiron and said overlay sheet from the bonded members.

13. A method according to claim 12, which comprises supplying said adhesive layer in the form of a polyamide mesh web.

14. A method according to claim 12, which comprises laminating said adhesive by fusion onto the back surfaces of a plurality of appliqué pieces, separating one of said pieces and the adhesive lamina thereon from the other pieces, and providing the separated piece as the member which is assembled with the second member.

15. A method according to claim 12, which comprises folding said overlay sheet about the assembled members and then effecting said squeezing and fusing.

16. A method of handicraft bonding by use of adhesive which at least in one phase is in a fluent state for adherence to a compatible surface, comprising:

preliminarily laminating heat reactivatable adhesive to one of said members;

assembling said members in face-to-face relation with the heat reactivatable adhesive lamina therebetween;

applying to said assembled members having said adhesive lamina therebetween an essentially nonporous self-supporting overlay sheet characterized by having all of the attributes of being thin, reusable, substantially frictionless, translucent and nonadherent with respect to said adhesive;

placing a pressing surface of a pressure applying means onto said applied overlay sheet;

exerting bonding pressure by means of said pressure applying means through said overlay sheet toward said members and thereby squeezing the adhesive lamina between said members;

effecting bonding of the pressurized assembled members by means of said adhesive lamina;

preventing by means of the protective layer provided by the overlay sheet any contamination of said pressing surface by adhesive that may migrate beyond the member which is contiguous to said pressing surface during said squeezing;

and finally removing said pressure applying means and said overlay sheet from said bonded members.

17. A method of handicraft bonding by use of adhesive which at least in one phase is in a fluent state for adherence to a compatible surface, comprising:

laminating by fusion onto the back surfaces of a plurality of appliqué pieces a heat reactivable adhesive;

separating one of said pieces and the adhesive lamina thereon from the other pieces;

providing the separated piece as one of a pair of members to be bonded to one another;

assembling said pair of members in face-to-face relation with said adhesive lamina therebetween;

applying to the assembled members having said lamina of adhesive therebetween an essentially nonporous self-supporting overlay sheet characterized by having all of the attributes of being thin, reusable, substantially frictionless, translucent and nonadherent with respect to said adhesive lamina;

placing a pressing surface of pressure applying means onto said applied overlay sheet;

exerting bonding pressure by means of said pressure applying means through said overlay sheet toward said members and thereby squeezing the adhesive lamina between said members;

effecting bonding of the pressurized assembled members by means of said adhesive lamina;

preventing by means of the protective layer provided by the overlay sheet any contamination of said pressing surface by adhesive that may migrate beyond the member which is contiguous to said pressing surface during said squeezing;

and finally removing said pressure applying means and said overlay sheet from said bonded members.

18. A method of handicraft bonding by use of adhesive which at least in one phase is in a fluent state for adherence to a compatible surface, comprising:

assembling in face-to-face relation members to be bonded to one another by a layer of said adhesive interposed between said members;

applying to the assembled members having a layer of the adhesive therebetween an essentially nonporous self-supporting overlay sheet characterized by having all of the attributes of being thin, reusable, substantially frictionless, translucent and nonadherent with respect to the adhesive;

placing a pressing surface of a pressure applying means onto said applied overlay sheet;

exerting bonding pressure by means of said pressure applying means through said overlay sheet toward said members and thereby squeezing the adhesive between said members;

effecting bonding of the pressurized assembled members by means of said adhesive;

preventing by means of the protective layer provided by the overlay sheet any contamination of said pressing surface during said squeezing;

removing said pressure applying means and said overlay sheet from said bonded members;

inserting between said members an opacity piece;

and bonding said opacity piece to said members.

19. A method of handicraft bonding by use of a adhesive which at least in one phase is in a fluent state for adherence to a compatible surface, comprising:

assembling in fact-to-face relation members to be bonded to one another by a layer of said adhesive interposed between said members;

applying to the assembled members having a layer of adhesive therebetween an essentially nonporous self-supporting overlay sheet characterized by having all of the attributes of being thin, reusable, substantially frictionless, translucent and nonadherent with respect to said adhesive;

placing the soleplate of a flatiron onto said applied overlay sheet;

exerting bonding pressure and adhesive fusing heat by means of said flatiron soleplate through said overlay sheet toward said members and thereby squeezing the adhesive between said members while moving said flatiron and thereby sliding said soleplate on said sheet;

effecting bonding of the pressurized assembled members by means of said adhesive;

preventing by means of the protective layer provided by the overlay sheet any contamination of said soleplate by adhesive that may migrate beyond the member which is contiguous to said soleplate during said squeezing;

and finally removing said pressure applying means and said overlay sheet from said bonded members.

* * * * *

UNITED STATES PATENT AND TRADEMARK OFFICE

CERTIFICATE OF CORRECTION

PATENT NO. : 4,597,812
DATED : July 1, 1986
INVENTOR(S) : Hamilton

It is certified that error appears in the above—identified patent and that said Letters Patent is hereby corrected as shown below:

Column 4, line 7, after "be" insert --self-supporting and--.

Column 6, line 54, for "be", second occurrence, read --by--.

Column 8, line 59, for "to", second occurrence, read --the--.

Signed and Sealed this

Thirteenth Day of January, 1987

*Attest:*

DONALD J. QUIGG

*Attesting Officer*

*Commissioner of Patents and Trademarks*